US008912727B1

(12) United States Patent
Brunell et al.

(10) Patent No.: US 8,912,727 B1
(45) Date of Patent: Dec. 16, 2014

(54) WAGERING GAME LIGHTING DEVICE CHAINS

(75) Inventors: Edward G. Brunell, Chicago, IL (US); Paul J. Radek, Naperville, IL (US)

(73) Assignee: WMS Gaming, Inc., Waukegan, IL (US)

( * ) Notice: Subject to any disclaimer, the term of this patent is extended or adjusted under 35 U.S.C. 154(b) by 883 days.

(21) Appl. No.: 13/109,427

(22) Filed: May 17, 2011

Related U.S. Application Data

(60) Provisional application No. 61/345,308, filed on May 17, 2010.

(51) Int. Cl.
*H05B 37/02* (2006.01)

(52) U.S. Cl.
USPC ..... 315/192; 315/189; 463/35

(58) Field of Classification Search
CPC ... A63F 13/12; A63F 2300/105; A63F 13/06; A63F 2300/1031; A63F 2300/1062; A63F 2300/807; A63F 13/02; A63F 2009/2402; A63F 2009/2433; A63F 2009/2452; A63F 2009/248; A63F 2009/2489
See application file for complete search history.

(56) References Cited

U.S. PATENT DOCUMENTS

| | | | | |
|---|---|---|---|---|
| 5,259,613 | A | 11/1993 | Marnell, II | |
| 5,483,631 | A | 1/1996 | Nagai et al. | |
| 5,633,933 | A | 5/1997 | Aziz | |
| 6,040,831 | A | 3/2000 | Nishida | |
| 6,081,266 | A | 6/2000 | Sciammaella | |
| 6,146,273 | A | 11/2000 | Olsen | |
| 6,217,448 | B1 | 4/2001 | Olsen | |
| 6,647,119 | B1 | 11/2003 | Slezak | |
| 6,843,723 | B2 | 1/2005 | Joshi | |
| 6,927,545 | B2 * | 8/2005 | Belliveau | 315/294 |
| 6,939,226 | B1 | 9/2005 | Joshi | |
| 6,960,136 | B2 | 11/2005 | Joshi et al. | |
| 6,972,528 | B2 | 12/2005 | Shao et al. | |
| 6,974,385 | B2 | 12/2005 | Joshi et al. | |
| 6,991,543 | B2 | 1/2006 | Joshi | |

(Continued)

FOREIGN PATENT DOCUMENTS

| | | |
|---|---|---|
| EA | 1439507 | 7/2004 |
| EP | 1439507 | 7/2004 |

(Continued)

OTHER PUBLICATIONS

"U.S. Appl. No. 12/965,749 Final Office Action", Apr. 22, 2013 , 30 pages.

(Continued)

*Primary Examiner* — Crystal L Hammond
(74) *Attorney, Agent, or Firm* — DeLizio Gilliam, PLLC

(57) ABSTRACT

In a wagering game environment, a light engine can determine a number of lighting devices that constitute a light chain, and a chaining configuration. The light chain is associated with a wagering game machine. The light engine can determine attributes of the constituent lighting devices and compute timing to produce the light effect. In accordance with the determined attributes and computed timing, the light engine generates output lighting device commands for controlling the lighting devices and/or light source elements of the constituent lighting devices. The light engine can dynamically handle a variation in the number or chaining configuration of the lighting devices that constitute the light at runtime. Accordingly, the light engine can generate appropriate output lighting device commands to display the appropriate light effects.

25 Claims, 7 Drawing Sheets

(56) References Cited

U.S. PATENT DOCUMENTS

| | | | | |
|---|---|---|---|---|
| 6,997,803 | B2 | 2/2006 | LeMay et al. | |
| 7,082,572 | B2 | 7/2006 | Pea et al. | |
| 7,112,139 | B2 | 9/2006 | Paz Barahona et al. | |
| 7,181,370 | B2 | 2/2007 | Furem et al. | |
| 7,228,190 | B2 | 6/2007 | Dowling et al. | |
| 7,364,508 | B2 | 4/2008 | Loose et al. | |
| 7,367,886 | B2 | 5/2008 | Loose et al. | |
| 7,449,839 | B1 | 11/2008 | Chen | |
| 7,479,063 | B2 | 1/2009 | Pryzby et al. | |
| 7,495,671 | B2 | 2/2009 | Chemel et al. | |
| 7,550,931 | B2 | 6/2009 | Lys et al. | |
| 7,666,091 | B2 | 2/2010 | Joshi et al. | |
| 7,682,249 | B2 | 3/2010 | Winans et al. | |
| 7,811,170 | B2 | 10/2010 | Winans et al. | |
| 7,867,085 | B2 | 1/2011 | Pryzby et al. | |
| 8,613,667 | B2 | 12/2013 | Brunell et al. | |
| 8,622,830 | B2 | 1/2014 | Radek et al. | |
| 2001/0021666 | A1 | 9/2001 | Yoshida et al. | |
| 2002/0010018 | A1 | 1/2002 | Lemay et al. | |
| 2002/0055978 | A1 | 5/2002 | Joon-Bo et al. | |
| 2002/0160826 | A1 | 10/2002 | Gomez et al. | |
| 2003/0002246 | A1 | 1/2003 | Kerr | |
| 2003/0007648 | A1 | 1/2003 | Currell | |
| 2003/0017865 | A1 | 1/2003 | Beaulieu et al. | |
| 2003/0130033 | A1 | 7/2003 | Loose | |
| 2003/0132722 | A1 | 7/2003 | Chansky et al. | |
| 2004/0072610 | A1 | 4/2004 | White et al. | |
| 2004/0160199 | A1 | 8/2004 | Morgan et al. | |
| 2004/0178750 | A1* | 9/2004 | Belliveau | 315/294 |
| 2004/0209692 | A1 | 10/2004 | Schober et al. | |
| 2005/0043090 | A1 | 2/2005 | Pryzby et al. | |
| 2005/0044500 | A1 | 2/2005 | Orimoto et al. | |
| 2005/0054440 | A1 | 3/2005 | Anderson et al. | |
| 2005/0077843 | A1 | 4/2005 | Benditt | |
| 2005/0116667 | A1 | 6/2005 | Mueller et al. | |
| 2005/0128751 | A1 | 6/2005 | Roberge et al. | |
| 2005/0153780 | A1* | 7/2005 | Gauselmann | 463/47 |
| 2005/0164785 | A1 | 7/2005 | Connelly | |
| 2005/0164786 | A1 | 7/2005 | Connelly | |
| 2005/0164787 | A1 | 7/2005 | Connelly | |
| 2005/0164788 | A1 | 7/2005 | Grabiec | |
| 2005/0174473 | A1 | 8/2005 | Morgan et al. | |
| 2005/0200318 | A1* | 9/2005 | Hunt et al. | 315/316 |
| 2005/0239545 | A1 | 10/2005 | Rowe | |
| 2005/0248299 | A1 | 11/2005 | Chemel et al. | |
| 2005/0275626 | A1 | 12/2005 | Mueller et al. | |
| 2005/0277469 | A1 | 12/2005 | Pryzby et al. | |
| 2005/0282631 | A1 | 12/2005 | Bonney et al. | |
| 2006/0009285 | A1 | 1/2006 | Pryzby et al. | |
| 2006/0022214 | A1 | 2/2006 | Morgan et al. | |
| 2006/0025211 | A1 | 2/2006 | Wilday et al. | |
| 2006/0046829 | A1 | 3/2006 | White | |
| 2006/0076908 | A1 | 4/2006 | Morgan et al. | |
| 2006/0244622 | A1 | 11/2006 | Wray | |
| 2006/0253781 | A1 | 11/2006 | Pea et al. | |
| 2007/0004510 | A1 | 1/2007 | Underdahl et al. | |
| 2007/0008711 | A1 | 1/2007 | Kim | |
| 2007/0032288 | A1 | 2/2007 | Nelson et al. | |
| 2007/0036368 | A1 | 2/2007 | Hettinger et al. | |
| 2007/0086754 | A1 | 4/2007 | Lys et al. | |
| 2007/0111776 | A1 | 5/2007 | Griswold et al. | |
| 2007/0189026 | A1 | 8/2007 | Chemel et al. | |
| 2007/0218970 | A1 | 9/2007 | Patel et al. | |
| 2007/0218974 | A1 | 9/2007 | Patel et al. | |
| 2007/0219000 | A1 | 9/2007 | Aida | |
| 2007/0291483 | A1 | 12/2007 | Lys | |
| 2007/0293304 | A1 | 12/2007 | Loose et al. | |
| 2008/0039213 | A1 | 2/2008 | Cornell et al. | |
| 2008/0070685 | A1 | 3/2008 | Pryzby et al. | |
| 2008/0094005 | A1 | 4/2008 | Rabiner et al. | |
| 2008/0113715 | A1 | 5/2008 | Beadell et al. | |
| 2008/0113796 | A1 | 5/2008 | Beadell et al. | |
| 2008/0113821 | A1 | 5/2008 | Beadell et al. | |
| 2008/0143267 | A1* | 6/2008 | Neuman | 315/192 |
| 2008/0161108 | A1 | 7/2008 | Dahl et al. | |
| 2008/0176647 | A1 | 7/2008 | Acres | |
| 2008/0231203 | A1 | 9/2008 | Budde et al. | |
| 2008/0274793 | A1 | 11/2008 | Seelig et al. | |
| 2008/0278946 | A1 | 11/2008 | Tarter et al. | |
| 2008/0288607 | A1 | 11/2008 | Muchow | |
| 2008/0309259 | A1 | 12/2008 | Snijder et al. | |
| 2009/0009997 | A1 | 1/2009 | Sanfilippo et al. | |
| 2009/0023485 | A1 | 1/2009 | Ishihata et al. | |
| 2009/0149242 | A1 | 6/2009 | Woodard et al. | |
| 2009/0170597 | A1 | 7/2009 | Bone et al. | |
| 2009/0197673 | A1 | 8/2009 | Bone et al. | |
| 2009/0206773 | A1 | 8/2009 | Chang | |
| 2009/0270167 | A1 | 10/2009 | Ajiro et al. | |
| 2009/0298579 | A1 | 12/2009 | Radek et al. | |
| 2009/0318223 | A1 | 12/2009 | Langridge et al. | |
| 2010/0022298 | A1 | 1/2010 | Kukita | |
| 2010/0022305 | A1 | 1/2010 | Yano | |
| 2010/0029385 | A1 | 2/2010 | Garvey et al. | |
| 2010/0031186 | A1 | 2/2010 | Tseng et al. | |
| 2010/0075750 | A1 | 3/2010 | Bleich et al. | |
| 2010/0113136 | A1 | 5/2010 | Joshi et al. | |
| 2010/0171145 | A1 | 7/2010 | Morgan et al. | |
| 2010/0213876 | A1 | 8/2010 | Adamson et al. | |
| 2010/0234107 | A1 | 9/2010 | Fujimoto et al. | |
| 2010/0277079 | A1 | 11/2010 | Van Der Veen et al. | |
| 2010/0309016 | A1 | 12/2010 | Wendt et al. | |
| 2010/0317437 | A1 | 12/2010 | Berry et al. | |
| 2011/0035404 | A1 | 2/2011 | Morgan et al. | |
| 2011/0045905 | A1 | 2/2011 | Radek | |
| 2011/0050101 | A1 | 3/2011 | Bailey et al. | |
| 2011/0070948 | A1 | 3/2011 | Bainbridge et al. | |
| 2011/0118018 | A1 | 5/2011 | Toyoda | |
| 2011/0118034 | A1 | 5/2011 | Jaffe et al. | |
| 2011/0190052 | A1 | 8/2011 | Takeda et al. | |
| 2012/0009995 | A1 | 1/2012 | Osgood | |
| 2012/0040738 | A1 | 2/2012 | Lanning et al. | |
| 2012/0122571 | A1 | 5/2012 | DeSimone et al. | |
| 2012/0129601 | A1 | 5/2012 | Gronkowski et al. | |
| 2012/0178523 | A1 | 7/2012 | Greenberg et al. | |
| 2012/0178528 | A1 | 7/2012 | Brunell et al. | |
| 2013/0005458 | A1 | 1/2013 | Kosta et al. | |
| 2013/0184078 | A1 | 7/2013 | Brunell et al. | |
| 2013/0310178 | A1 | 11/2013 | Pryzby et al. | |
| 2014/0073430 | A1 | 3/2014 | Brunell et al. | |

FOREIGN PATENT DOCUMENTS

| | | |
|---|---|---|
| WO | WO2004086320 | 10/2001 |
| WO | WO-2004014501 | 2/2004 |
| WO | WO2004075128 | 9/2004 |
| WO | WO2004075129 | 9/2004 |
| WO | WO2005113089 | 12/2005 |
| WO | WO2005114598 | 12/2005 |
| WO | WO2005114599 | 12/2005 |
| WO | WO2005117647 | 12/2005 |
| WO | WO2006017444 | 2/2006 |
| WO | WO2006017445 | 2/2006 |
| WO | WO2006033941 | 3/2006 |
| WO | WO2006039284 | 4/2006 |
| WO | WO2006039323 | 4/2006 |
| WO | WO2006125013 | 11/2006 |
| WO | WO2007022294 | 2/2007 |
| WO | WO2007022343 | 2/2007 |
| WO | WO-2007061904 | 5/2007 |
| WO | WO2007133566 | 11/2007 |
| WO | WO2008057538 | 5/2008 |
| WO | WO2008063391 | 5/2008 |
| WO | WO2008137130 | 11/2008 |
| WO | WO2009054930 | 4/2009 |
| WO | WO2010048068 | 4/2010 |
| WO | WO-2011005797 | 1/2011 |
| WO | WO2011005798 | 1/2011 |
| WO | WO2011014760 | 2/2011 |
| ZA | 20041110 | 8/2005 |

OTHER PUBLICATIONS

"U.S. Appl. No. 12/971,544 Final Office Action", Mar. 14, 2013 , 38 pages.

(56) References Cited

OTHER PUBLICATIONS

Gusella, Riccardo et al., "An Election Algorithm for a Distributed Clock Synchronization Program", *Berkley* http://www.eecs.berkeley.edu/Pubs/TechRpts/1986/CSD-86-275.pdf Dec. 1985, 19 pages.
U.S. Appl. No. 12/797,756, filed Jun. 10, 2010, Berry, Robert G., et al.
U.S. Appl. No. 12/860,467, filed Aug. 20, 2010, Radek, Paul J.
U.S. Appl. No. 12/965,749, filed Dec. 10, 2010, Brunell, Edward G., et al.
U.S. Appl. No. 12/971,544, filed Dec. 17, 2010, Brunell, Edward G., et al.
U.S. Appl. No. 13/094,701, filed Apr. 26, 2011, Brunell, Edward G., et al.
U.S. Appl. No. 13/094,811, filed Apr. 26, 2011, Brunell, Edward G., et al.
U.S. Appl. No. 13/094,560, filed Apr. 26, 2011, Brunell, Edward G., et al.
"PCT Application No. PCT/US10/41112 International Search Report", Sep. 2, 2010 , 11 pages.
"PCT Application No. PCT/US10/43886 International Search Report", Sep. 16, 2010 , 12 pages.
"U.S. Appl. No. 12/860,467 Office Action", Jan. 17, 2013 , 16 pages.
"U.S. Appl. No. 13/382,738 Final Office Action", Mar. 12, 2014 , 23 Pages.
U.S. Appl. No. 14/254,656, filed Apr. 16, 2014, Berry, Robert G., et al.
"U.S. Appl. No. 13/094,560 Office Action", Mar. 30, 2012 , 13 pages.
"U.S. Appl. No. 13/094,701 Office Action", Mar. 27, 2012 , 26 pages.
"U.S. Appl. No. 13/094,811 Office Action", Apr. 3, 2012 , 16 pages.
"PCT Application No. PCT/US10/41111 International Preliminary Report on Patentability", Oct. 24, 2011 , 13 pages.
"PCT Application No. PCT/US10/41111 International Search Report", Sep. 1, 2010 , 12 pages.
"PCT Application No. PCT/US10/41112 International Preliminary Report on Patentability", Aug. 31, 2012 , 4 pages.
"PCT Application No. PCT/US10/43886 International Preliminary Report on Patentability", May 3, 2012 , 4 pages.
"U.S. Appl. No. 13/094,811 Office Action", Jun. 21, 2013 , 19 pages.
"U.S. Appl. No. 13/204,225 Office Action", Feb. 27, 2013 , 19 pages.
"U.S. Appl. No. 13/204,225 Office Action", Jun. 22, 2012 , 23 pages.
"U.S. Appl. No. 13/382,738 Office Action", Feb. 7, 2013 , 41 pages.
"U.S. Appl. No. 13/382,783 Office Action", Feb. 28, 2012 , 26 pages.
"U.S. Appl. No. 13/382,783 Office Action", Jul. 25, 2013 , 20 Pages.
"U.S. Appl. No. 12/797,756 Office Action", Nov. 7, 2013 , 7 Pages.
"U.S. Appl. No. 12/965,749 Office Action", Dec. 17, 2013 , 35 Pages.
"U.S. Appl. No. 13/094,560 Office Action", Dec. 6, 2013 , 9 Pages.
"U.S. Appl. No. 13/382,738 Office Action", Sep. 24, 2013 , 24 Pages.
"U.S. Appl. No. 13/388,118 Office Action", Oct. 11, 2013 , 9 Pages.
U.S. Appl. No. 14/080,272, filed Nov. 14, 2013, Brunell, Edward G., et al.
"U.S. Appl. No. 12/965,749 Office Action", Nov. 8, 2012 , 30 pages.
"U.S. Appl. No. 12/971,544 Office Action", Nov. 6, 2012 , 43 pages.
"U.S. Appl. No. 13/094,701 Final Office Action", Nov. 28, 2012 , 14 pages.
"Coyote Moon", *IGT*http://web.archive.org/web/20131213220054/http://media.igt.com/marketing/Promotionalliterature/GamePromolit_111E3-29BC7.pdf 2005 , 2 pages.
"Elvis Little More Action", *24Hr-Slots* http://www.24hr-slots.co.uk/WagerWorks/Elvis_ALMA.html Sep. 5, 2009, 4 pages.
"U.S. Appl. No. 13/094,811 Final Office Action", Dec. 24, 2013 , 15 Pages.
NYPHINIX13, "Star Wars Cloud City Slot Bonus—IGT", *YouTube* http://www.youtube.com/watch?v=wfYL9hjLxg4 Mar. 18, 2010 , 1 page.

* cited by examiner

WAGERING GAME LIGHTING DEVICE CHAINS

RELATED APPLICATIONS

This application claims the priority benefit of U.S. Provisional Application Ser. No. 61/345,308 filed May 17, 2010.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to controlling a chain of lighting devices in a wagering game environment.

BACKGROUND

DMX commands are transmitted to dimmers, moving light controllers, and other light control elements to vary lighting. In a DMX network, a master DMX controller transmits DMX commands to slave devices (e.g., the dimmers, the moving light controllers) to produce light effects. The master DMX controller transmits a packet comprising multiple slots. The slots either specify the type of data in the packet or contain control settings for the slave devices. The slave device and the function of the slave device are determined by the position of the slot in the packet. The control setting is indicated by the data in the slot.

BRIEF DESCRIPTION OF THE FIGURES

Embodiments of the invention are illustrated in the Figures of the accompanying drawings in which:

FIG. 1A is an example conceptual diagram for dynamically controlling light effects across a light chain. FIG. 1B continues from FIG. 1 and conceptually depicts operations of the light engine 112, and the light control board 106 to carry out the light chain commands.

DESCRIPTION OF THE EMBODIMENTS

Figure 1A:
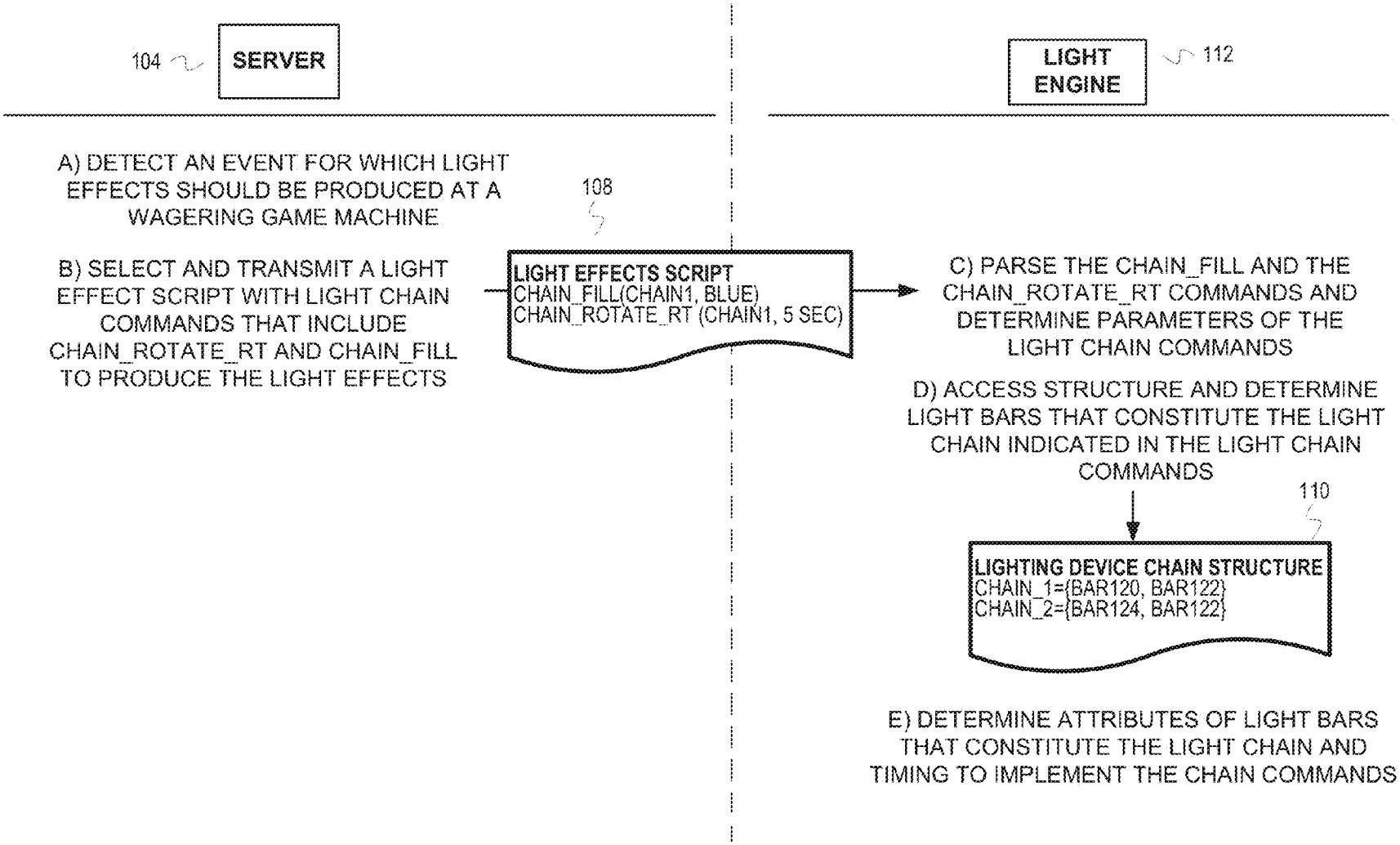
FIG. 1A and FIG. 1B depict conceptual diagrams of an example system that uses a light chain to produce light effects across a group of lighting devices.

The description that follows includes exemplary systems, methods, techniques, instruction sequences, and computer program products that embody techniques of the present inventive subject matter. However, it is understood that the described embodiments may be practiced without these specific details. For instance, although examples refer to accessing a structure to determine properties of light bars that constitute a light chain, in other embodiments, the light bars may be queried to determine the properties of the light bars. Also, although examples refer to chaining light bars comprising LEDs, in other embodiments, any suitable lighting devices may be chained together. In other instances, well-known instruction instances, protocols, structures, and techniques have not been shown in detail in order not to obfuscate the description.

Light effect scripts dictate how light effects should be displayed across multiple light bars on wagering game machines. Alight effect script individually addresses and controls light effect(s) across each of the multiple light bars. For example, to generate a light effect of light appearing to move across multiple light bars, each light bar in the multiple light bars is individually addressed and controlled. Attributes and timing for each of the multiple light bars are coded, into the script, on a frame-by-frame basis because each of the light bars have a different behavior from one light frame (or one time instant) to the next. Individually programming each light bar to generate the light effects can involve determining an exact timing (e.g., when the light source elements in the light bars turn ON/OFF) and attributes (e.g., intensity, color, etc.) or range of attributes for each of the light bars. When the light source elements in each of the multiple light bars is individually controlled in accordance with the calculated timing and attributes, the light effect is produced.

Addressing and controlling each light bar can be a time-intensive and labor-intensive task. The amount of effort associated with individually programming attributes and timing of each light bar to generate the light effects only increases with the number of light bars involved in producing the light effects. Moreover, a light effect script that individually addresses each light bar is static and cannot handle variations in the light bars (e.g., number and type of light bars) and variations in configuration (e.g., a change in flow of light from one light bar to another). For example, if the number or configuration of light bars across which the light effects are to be produced is changed, the timing and attributes of the light bars may have to be recalculated and the light effect script may have to be reprogrammed to generate the light effects across the new light bars.

Lighting devices (e.g., light bars, light strips, light panels, etc.) can be "chained" together to reduce complexity associated with displaying light effects and to reduce verbosity of (e.g., number of commands in) the light effect script that dictates the light effects. Chaining the lighting devices together refers to grouping individual light devices into a logical group (hereinafter referred to as a "light chain"). The group of lighting devices that constitute the light chain can be addressed and controlled as a single unit. Chaining the lighting devices facilitates configuration of a flow path that describes how light should flow through a light chain from one lighting device to a next lighting device. A system or light effect script can use light chain commands to address and control the light chain as a single unit to switch ON/OFF the constituent lighting devices, display fade in/fade out effects across the constituent lighting devices, display moving light effects across the constituent lighting devices, display gradient effects across the constituent lighting devices, etc. Moreover, a light chain command can control a mixture of different types of lighting devices as a single unit. For instance, a light chain can be comprised of light bars, and an LED light strip.

Responsive to receiving a light chain command that references a light chain, a light engine can determine a number of lighting devices that constitute the light chain, and a chaining configuration (e.g., flow of light from one lighting device to another in the light chain, orientation of the lighting devices, order of the lighting devices, hierarchy of the lighting devices, etc.). The light engine can determine attributes of the constituent lighting devices and compute timing to produce the light effect. In accordance with the determined attributes and computed timing, the light engine generates output lighting device commands for controlling the lighting devices and/or light source elements of the constituent lighting devices. The light engine can dynamically handle a variation in the number or chaining configuration of the lighting devices that constitute the light at runtime. Accordingly, the light engine can generate appropriate output lighting device commands to display the appropriate light effects. Chaining lighting devices in conjunction with a dynamic determination of lighting device attributes and timing values allows for a display of complex light effects with minimal user input, and allows for granularity independent rendering of light effects irrespective of the number or chaining configuration of the lighting devices across which the light effects are to be displayed.

Figure 1B:
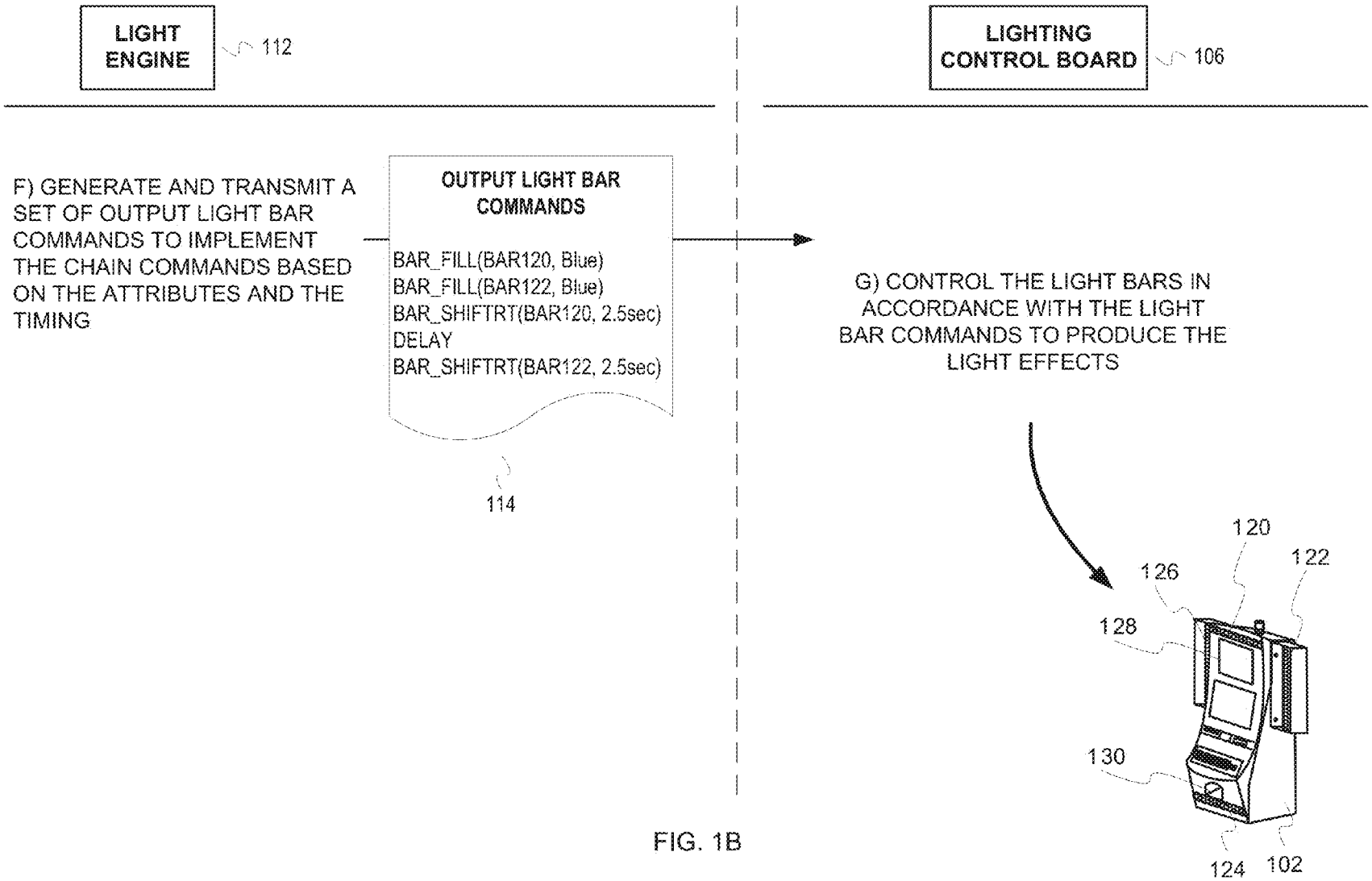

FIG. 1A and FIG. 1B depict conceptual diagrams of an example system that uses a light chain to produce light effects across a group of lighting devices. FIGS. 1A and 1B depict a system that comprises a server 104, a light engine 112, a lighting control board 106, and a wagering game machine 102. FIG. 1A conceptually depicts operations of the server 104 and the light engine 112 to carry out light chain commands to produce light effects. FIG. 1B continues from FIG. 1 and conceptually depicts operations of the light engine 112, and the light control board 106 to carry out the light chain commands. The server 104 may be a wagering game server that controls and presents wagering games on the wagering game machine 102, a bonus game server that presents bonus games or rewards in response to game-based events, a dedicated lighting server, etc. The server 104 is communicatively coupled to the light engine 112, and the light engine 112 is coupled to the lighting control board 106. The light engine 112 has access to a lighting device chain structure 110. The lighting control board 106 controls lighting of light source elements on the wagering game machine 102. Embodiments can vary the architecture of the system. For instance, the server 104 can host the light engine 112 and/or the lighting device chain structure 110. As another example, the light engine 112 can be implemented on a machine separate from the server, and the lighting device chain structure 110 can be implemented in a storage device separate from the server 104 and the light engine 112. Further, the lighting device chain structure can be implemented as hardware (e.g., a hardware table) in the light engine 112 or the server 104, as a structure(s) encoded in a network attached storage device, as a structure(s) encoded in a storage device local to the light engine 112, etc.

At stage A, the server 104 detects an event for which light effects should be produced at the wagering game machine 102. The server 104 can detect a multitude of various events and combinations of events and/or condition for a lighting effect(s). For example, the server 104 may detect or receive a notification of a game-based event and determine one or more lighting effects associated with the game-based event. As another example, the server 104 can detect fulfillment of a time based condition. The server 104 can determine that a light effect should be produced at the wagering game machine 102 when a specified time interval has elapsed, perhaps since a wagering game machine has been active.

At stage B, the server 104 selects and transmits a light effects script 108 with light chain commands that include CHAIN_ROTATE_RT and CHAIN_FILL to the light engine 112. The server 104 can select a light script that maps directly to an event or that maps indirectly to an event. A light script can map indirectly to an event through a light effect representation, for example. To illustrate, an event can map to a light effect category "Celebrate Bonus Win," which is associated with a particular light script. A light chain command addresses a light chain and identifies light effects that should be generated across the light chain. As described above, the light chain is a logical grouping of lighting structures bars on the wagering game machine that allows the group of light bars that constitutes the light chain to be addressed as a single unit (e.g., using a single light chain command). For example, a light chain may comprise the light bar 120 and the light bar 126. To generate light effects in the light bars 120 and 126 where the lights appear to move to the right, a single light chain command directing that light in the light chain move to the right may be issued.

In response to detecting the event at stage A, the server 104 selects the light effects script 108. FIG. 1 depicts the light effect script 108 as comprising two light chain commands—the CHAIN_FILL command and the CHAIN_ROTATE_RT command. However, the light effects script 108 could comprise any suitable number of light chain commands. In some implementations, the light effect scripts 108 may be part of another script that comprises mechanical commands, audio commands, other lighting commands, etc. For example, the CHAIN_FILL and CHAIN_ROTATE_RT commands may be preceded by a PLAY_AUDIO command and may be followed by a STOP_AUDIO and MOVE_STRUCTURE command. The server 104 then transmits the selected light effects script 108 to the light engine 112. In some implementations, a script interpreter (not shown) may identify the light chain command, and pass the light chain command along with parameters of the light chain command to the light engine 112. In another implementation, the wagering game machine 102 selects the light effects script 108, and transmits the light effects script 108 to the light engine 112. In another implementation, the server 104 transmits the light effects script 108 to the wagering game machine 102, where the wagering game machine 202 executes the light effect script 108, identifies the light chain commands, and passes the light chain commands to the light engine 112.

At stage C, the light engine 112 parses the CHAIN_FILL and the CHAIN_ROTATE_RT commands and determines parameters of the light chain commands. The parameters of a light chain command typically comprise a light chain identifier, which is associated with an indication of the lighting devices that constitute the light chain. In addition, the light chain command may also indicate other parameters such as a light color, a light intensity, a time for which the light effect should be displayed, etc. The parameters of the light chain command may vary depending on the light effect to be displayed on the wagering game machine 202.

With reference, to FIG. 1, the light engine 112 parses the CHAIN_FILL command for setting the color of light source elements in the light chain, and determines that the color of the light source elements in the light chain identified by "CHAIN_1" should be set to blue. Also, the light engine 112 parses the CHAIN_ROTATE_RT command and determines that the light colors of the light source elements, in the light chain CHAIN_1, should rotate to the right within a time interval of 5 seconds. To illustrate another example of a light chain command, the light engine 112 may analyze a "CHAIN_GRADIENT" command and determine a beginning light color and an ending light color. The CHAIN_GRADIENT command may also indicate a light intensity, a beginning light intensity, an ending light intensity, etc.

At stage D, the light engine 112 determines lighting devices that constitute the light chain indicated by the light chain commands. The light engine 112 accesses the lighting device chain structure 110 to determine the lighting devices that constitute the light chain represented by the light chain identifier. The lighting device chain structure 100 represents an association or mapping between the lighting devices that constitute the light chain and the light chain identifier. The lighting device chain structure 110 indicates the lighting devices that should be treated as a single unit when presenting light effects. The chain identifier can be manually assigned or dynamically assigned to lighting devices. As an example of a dynamic assignment, the light engine (or another component, process, etc.) can detect or receive notification of coupling of a new lighting device to a lighting device already associated with a light chain. In FIG. 1, the light engine 112 accesses the lighting device chain structure 110 and determines that the light chain represented by CHAIN_1 comprises a light bar 120 and a light bar 122.

The lighting device chain structure 110 can also indicate an order in which the light bars 120 and 122 are chained, so that the light engine 112 can determine a flow path for light effects across the light chain. In other words, the order in which the light bars are chained defines a flow of light in the light source elements from one light bar to another. The order of the lighting device in a light chain can be indicated explicitly (e.g., order values) or implicitly (e.g., as they occur in a data structure). The light engine 112 determines, based on information in the lighting device chain structure 110, that the light bar 122 follows the light bar 120 for ordering. In other words, movement of light (in the light chain) starts at the light bar 120 and moves to the light bar 122. In addition to determining the light bars that constitute the light chain, the light engine 112 can also determine other attributes of the light chain and/or the constituent lighting devices.

At stage E, the light engine 112 determines attributes of the constituent lighting devices and determines timing to implement the chain commands. Examples of attributes include a position of and a number of light source elements in each of the lighting devices that constitute the light chain, a position of the light bars 120 and 122, color, intensity, tilt, pan, etc. of the light source elements that constitute the light bars 120 and 122. The timing of operations for the light bars can indicate a time instant at which the light source elements are switched ON/OFF, a time interval for which the light effects indicated by the light chain command should be displayed, etc. The light engine 112 determines how to manipulate the lighting devices based on the parameters of the light chain command, attributes of the lighting devices, and timing to generate the light effects. Based on knowledge of the number of light bars in the light chain, the light engine 112 may determine a total number of and identifiers of light bars across which the light effects should be produced. As mentioned above, the light engine can also determine and use attributes of the light chain. Examples of light chain attributes include configuration (e.g., circle, frame, etc.), resolution of the light chain based on the attributes and number of constituent lighting devices, capabilities of the light chain based on the aggregate capabilities of the constituent lighting devices. The attributes of the constituent lighting devices can be maintained in the lighting device chain structure, or in a separate structure. In other embodiments, the light engine 112 can access/query device drivers to determine attributes of the light bars 120 and 122. The attributes that can be determined and techniques for determining the attributes can vary with each light chain.

Based on the attributes, the light engine 112 can determine operations to implement the chain commands. For example, for the CHAIN_FILL light chain command, the light engine 112 may determine that each of the light bars should display a blue color with a high intensity. For the CHAIN_ROTATE_RT command, the light engine 112 may determine that to rotate the light around two light bars in 5 seconds, light transitions (e.g., from one light bar to a next light bar) should take place every 2.5 seconds. Additionally, the light engine 112 may also determine a time instant at which each of the light bars should begin displaying the light transitions in order to generate the rotating light effects. For example, the light engine 112 may determine that the light bar 120 should begin displaying the light transitions at t=o second and stop displaying the light transitions at t=2.5 seconds. The light engine 112 may also determine that the light bar 122 should begin displaying the light transitions at t=2.6 seconds and stop displaying the light transitions at t=5 seconds.

In addition to determining the attributes and timing of the light bars, the light engine 112 may also determine position of structures that do not emit light. In some implementations, some or all of the light source elements may be housed in metal or plastic containers to focus a light beam in a particular direction. For example, a light source element may be housed in an opaque container with a lens on the top that focuses light in the upwards direction. The light engine 112 may determine an angle by which to rotate or a distance by which to move the containers to change the direction of the light beam. For example, in order to direct the light beam in the downwards direction, the light engine 112 may determine the container should be rotated by 180 degrees. As another example, light engine 112 may determine an angle by which a yoke should be rotated in order to change the direction of the light beam.

As part of the light effects, the light engine 112 may also determine how reflectors should be moved so that the light beams from the light source elements reflect off of the reflectors to produce the desired light effects. The reflectors may be moved around to help direct or guide the light beam in a particular direction.

Figure 2:
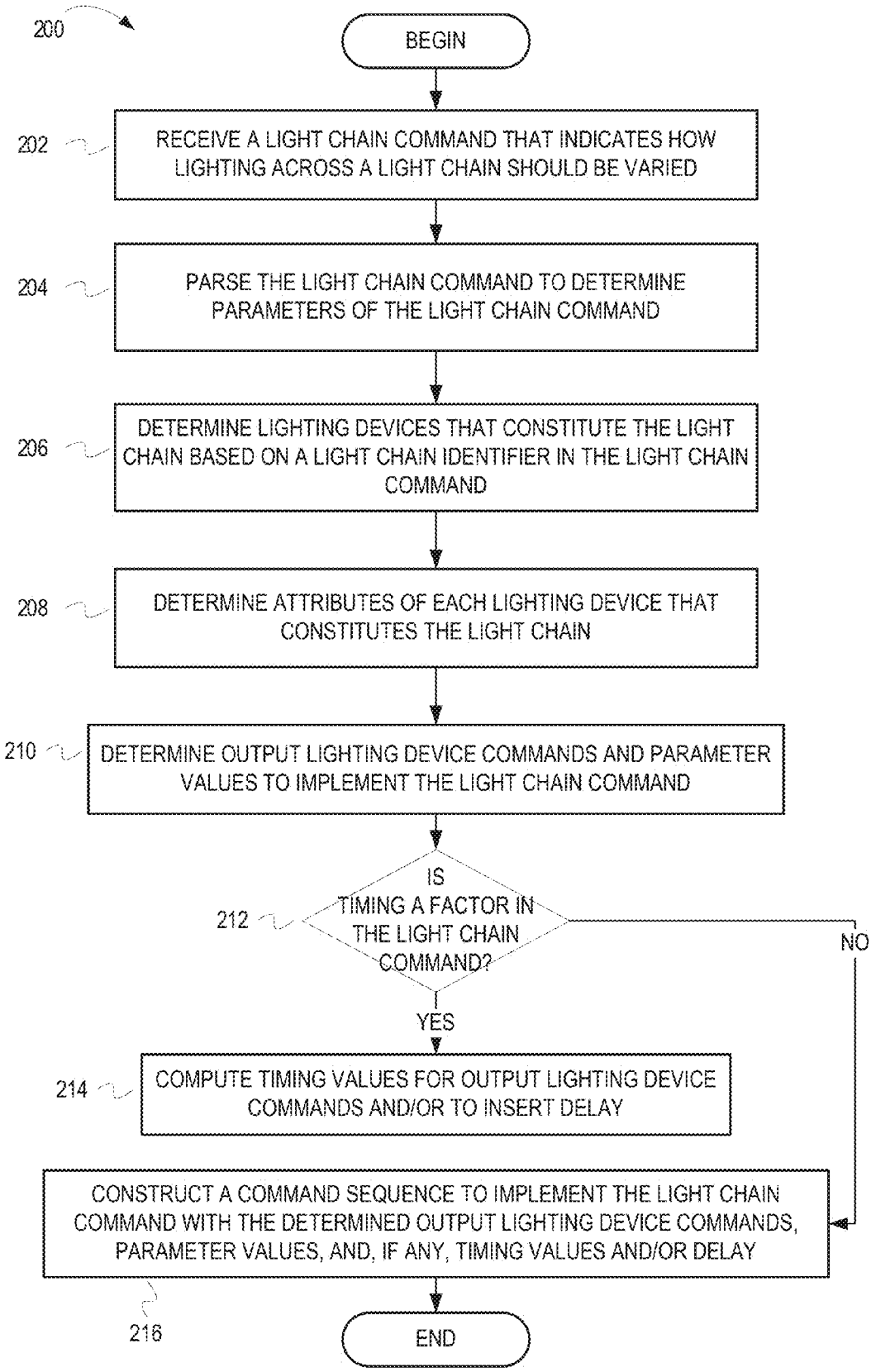
FIG. 2 is a flow diagram illustrating example operations for dynamically controlling light effects across a light chain.

The variety of attributes to be taken into consideration can be illustrated with reference to the wagering game machine 102 depicted in FIG. 2. FIG. 2 depicts the wagering game machine 102 with four light bars 120, 122, 124, and 126 respectively affixed above a secondary display 128, on a right side of the wagering game machine 102, below a payout mechanism 130, and on a left side of the wagering game machine 102. The light bars comprise a set of light source elements. Examples of light source elements include light emitting diodes (LEDs), light bulbs, lamps, fluorescent lights, high intensity discharge lamps (HID lamps), and gas discharge lamps. In some implementations, the light bars comprise a set of LED light pixels. Each LED light pixel can comprise any suitable number of red, green, and blue LEDs that can be used to display a desired color. The light barsmay comprise any suitable number of LED light pixels (e.g., 16 LED light pixels, 32 LED light pixels, etc.). Also, the wagering game machine 102 can comprise any suitable number of light bars. For example, the wagering game machine 102 can comprise eight light bars—two light bars affixed above the secondary display 128, two light bars on the right side, two light bars on the left side, and two light bars on below the payout mechanism 130 of the wagering game machine 102. In another implementation, the wagering game machine 102 can comprise any suitable lighting structure that constitutes any suitable light source elements. For example, the wagering gamemachine 102 may comprise strip lights (instead of light bars) comprising multiple LEDs—each of which emit different colored light. In another implementation, the light bar may comprise lamps covered with colored glass lenses or gels so that the lamps project different colors of light.

At stage F, the light engine 112 generates and transmits, to the lighting control board 106, a set of output lighting device commands to implement the light chain commands. The light engine 112 can generate output lighting device commands, in this case bar commands, in accordance with different techniques. In one embodiment, the light engine 112 maps or translates the light chain commands to lighting device commands. In other embodiments, the light engine can consult libraries of lighting device commands, and build output lighting device commands based on the targeted lighting device and attributes. The generation of lighting device commands for light chain commands will vary based on the attributes of the light chain, parameters of the light chain commands, attributes of the lighting devices, etc. In FIG. 1B, the light engine 112 determines that the CHAIN_FILL command is implemented with a BAR_FILL command for each constituent light bar in FIG. 2. In the output lighting device commands 114, the light engine 112 generates lighting device commands BAR_FILL (BAR 120, Blue) and BAR_FILL (BAR 122, Blue) in response to the CHAIN_FILL command to indicate the light source elements in the light bars 120 and 122 should display a blue color. The "Blue" parameter value of the CHAIN_FILL command carries over to the BAR_FILL commands. For the CHAIN_ROTATE command, the light engine 112 determines that the chain command can be implemented with BAR_SHIFTRT commands for each constituent light bar, as well as a DELAY command between the BAR_SHIFTRT commands. Instead of carry over the parameter value of 5 seconds from the light chain command, the light engine 112 determines that a timing parameter for the BARSHIFT_RT commands should be set to 2.5 seconds. The output lighting device command BAR_SHIFTRT (BAR 120, 2.5 seconds) indicates that the light in the light source elements comprising the light bar 120 should be shifted to the right so that light shift effects are completed in 2.5 seconds (determined as the total amount of time the rotating light effect should be displayed (e.g., 5 seconds) divided by the number of light bars in the light chain (e.g., 2)). The DELAY command can indicate a time interval for which the lighting control board 106 should wait before initiating the BAR_SHIFTRT command for the light bar 122.

At stage G, the lighting control board 106 controls the light bars 120 and 122 that constitute the light chain in accordance with the output lighting device commands to produce the light effects. Based on the output lighting device commands 114 received from the light engine 112, the lighting control board 106 can generate control commands to control lighting control structures and consequently the attributes of the light source elements in the light bar. The lighting control structures can comprise dimmers and faders that control the intensity of the light emitted by light source elements. The lighting control structures may also comprise automated lighting controllers that control movement, orientation (e.g., pan and tilt), and color of lights. In one implementation, the light control board may comprise a DMX controller that receives the output lighting device commands, and generates and transmits DMX data to the lighting control elements. For example, in response to receiving the BAR_FILL commands, the lighting control board 106 may generate DMX data (or other digital data) that directs dimmers to vary intensity of light emitted by light source elements that constitute the light bar in order to display the blue color.

It should be noted that any suitable number of lighting devices can be chained together to form a light chain and that the lighting devices in the light chain can be chained together in any order. Moreover, multiple light chains can be implemented on a wagering game machine using the same lighting devices. For example, the light bars 120, 122, 124, and 126 can be chained to form a first light chain, while the light bars 122 and 126 may be chained together to form a second light chain. Also, different light chains may comprise the same light bar(s) chained together using different combinations. For example a first light chain may comprise the light bars 120, 122, and 126 chained together so that light moves from the light bar 120, to the light bar 122, and finally to the light bar 126. A second light chain may comprise the same three light bars 120, 122, and 126 chained in a different order so that the lighting effects begin at the light bar 126 and move from the light bar 126, to the light bar 120, and finally to the light bar 122.

It should also be noted that the number of light bars in the light chain can be changed at any point in time without affecting the light chain commands in the light effect script 108 or affecting execution of the light effect script 108. The light effect script is independent of the number of the light bars that constitute the light chain and the number of light source elements in each light bar. The light effect script 108 is a generic script that addresses the light chain and that allows for dynamic querying of a current configuration of the light bars in order to create light effects. Because the light effect script 108 addresses the light chains instead of individual light bars, the light effect script 108 is adaptable to variations in hardware configurations. The lighting device chain structure 110 may be updated to reflect changes made to the light bars that constitute the light chain. For example, the lighting device chain structure 110 may be updated to add the light bar 126 to the light chain identified by "CHAIN_1". When light commands that address CHAIN_1 are received, the light bars 120, 122, and 124 are identified as the light bars that constitute CHAIN_1 and light effects are displayed across the three light bars 120, 122, and 124 as described with reference to FIG. 1.

In some implementations, the light barsmay comprise variable-wavelength light source elements and the light engine 112 may determine wavelengths of light that the light source elements should emit in order to produce light with varying colors. For example, parameters of the BAR_FILL command in the output lighting device commands 114 may comprise the light bar identifier and a wavelength of the light color that should be emitted by the light source elements. For example, BARFILL (BAR 120, 475 nm) may indicate that the light source elements in the light bar 120 should emit color with a wavelength of 475 nm (i.e., a blue colored light).

Example Operations

This section describes operations associated with some embodiments of the invention. In the discussion below, the flow diagrams will be described with reference to the block diagrams presented above. However, in some embodiments, the operations can be performed by logic not described in the block diagrams. In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

FIG. 2 is a flow diagram illustrating example operations for controlling light effects across a light chain. Flow 200 begins at block 202.

At block 202, a light chain command that indicates how lighting across a light chain should be varied is received. For example, a light engine 112 of FIG. 1 may receive the light chain command from a server. The server may be a wagering gamemachine server that detects an event (e.g., a game based event, an elapsed time interval, etc.) and executes a light effect script based on the detecting the event. On encountering the light chain command in the light effect script, the server can pass the light chain command to the light engine. As another example, the light chain command may be received from the wagering game machine. A script interpreter running on the wagering game machine may identify the light chain command and transmit the light chain command to the light engine 112. The flow continues at block 204.

At block 204, the light chain command is parsed to determine parameters of the light chain command. At least one of the parameters of the light chain command can indicate a light chain identifier that represents lighting devices that constitute the light chain. The parameters of the light chain command can also indicate an intensity of light source elements that constitute the lighting devices, a time interval for which the light source elements should display a light effect, a starting and an ending light intensity (for light effects showcasing a variation of light intensity), a starting and an ending color (for gradient light effects), etc. The flow continues at block 206.

At block 206, the lighting devices that constitute the light chain are determined based on the light chain identifier indicated by the light chain command. As described above, the light chain is a logical grouping of multiple lighting devices. Once chained, the lighting devices that constitute the light chain may be addressed and controlled as a single unit. The light chain identifier identifies the lighting devices that constitute the light chain and a configuration of the light lighting devices that constitute the light chain. The lighting devices that constitute the light chain may be chained together in any order and the order of chaining indicates a flow path of light from one lighting device to a next lighting device. For example, it may be determined that a light bar on top of the wagering machine is chained to a light bar on the left of the wagering game machine. It may also be determined that the two light bars are chained such that the light bar on the top is the first light bar while the light bar on the left is the second light bar in the light chain. Lighting effects, when initiated for the light chain will, therefore, start at the first light bar, move through the first light bar, spill into the second light bar, move through the second light bar, spill back into the first light bar (based on the light chain command), and so on. Different combinations of a same set of light bars may be assigned different light chain identifiers. The information about the light chain can be stored in accordance with a variety of techniques (e.g., a light chain configuration file, a data structure indexed by the light chain identifier, a data structure identified by the chain identifier, etc.). The flow continues at block 208.

At block 208, attributes of each lighting device are determined. Examples of attributes include intensity, color, number of nodes, type of lighting device, etc. Embodiments can determine the lighting device attributes in accordance with different techniques. Embodiments can indicate the attributes of each lighting device in the same data structure that indicates the light chain. Embodiments can indicate the attributes in a separate structure referenced by or associated with the light chain data structure. For instance, a light engine can follow references in a light chain data structure to lighting device attribute data. In other embodiments, the light engine can query a store of attribute data or the lighting devices themselves to determine lighting device data.

At block 210, output lighting device commands to implement the light chain command are determined. Parameter values for the commands are also determined. Determining the lighting device commands can involve multiple operations and/or multiple levels of analysis of the light chain command. In addition, the operations and/or level of analysis can vary based on the light chain command.

In some cases, associations can be pre-defined between a light chain command and the one or more lighting device commands to implement the light chain command. There may be no parameter values, or the parameters values may translate directly from the light chain command to the implementing lighting device commands. For example, a color parameter value in a light chain command may carry over to the lighting device command(s). Although a single lighting device command may implement a light chain command, multiple instances of the lighting device command will implement the light chain command across the constituent lighting devices.

In other cases, the parameter values for implementing lighting device commands will be modified or generated. For instance, a light chain command can cause a light chain to create a gradient effect. The light chain command can have parameters for a starting color and an ending color. An example light engine will use the starting color for a lighting device command directed to a first constituent lighting device, and generate an ending color for the first constituent lighting device. For each of the intermediary constituent lighting devices, the light engine will determine a starting and ending color based on the configuration of the light chain. For the last constituent lighting device, the light engine will use the ending color from the light chain command, and generate a starting color.

In other cases, a light engine may dynamically construct a sequence of implementing lighting device commands to implement a light chain command. For example, a light chain command can be defined with tags and/or a description of the lighting effect to be created with the light chain command. In some embodiments, the light engine can analyze the tags and/or description and select lighting device commands based on evaluating names of lighting device commands against the tags and/or description. In some embodiments, lighting device commands may be categorized. A light engine can construct a sequence of lighting device commands based on analysis of the light chain command tags and/or description against categories of the lighting device commands. The light engine can further refine the selection of lighting device commands within categories based on analyzing tags of the lighting device commands. In some embodiments, the lighting device commands are not categorized, but have tags and/or descriptions. A light engine can select lighting device commands based on the tags/descriptions, and heuristics or language analysis.

At block 212, it is determined if timing is a factor in the light chain command. A light engine can determine that timing is a factor based on parameters of a light chain command. The light chain command may explicitly have a time parameter. In other light chain commands, timing can be a factor because the light effect involves activity by the constituent lighting devices at different times (e.g., a light effect that moves across constituent lighting devices). In such cases, the light engine can determine that timing is a factor based on the light chain command (e.g., a light chain command to cause a moving light effect has a timing element), based on parameters of implementing lighting device commands (e.g., output lighting device commands have a timing parameter), etc. If timing is a factor in the light chain command, then control flows to block 214. If timing is not a factor then control flows to block 216.

At block 214, timing values for output lighting device commands are computed. It may also be determined delay should be utilized to implement the light chain command. Computing time values and/or determining utility of delay can range from less complex operations to more complex operations. For some timing parameters, a light engine can divide the timing value of the light chain command by the number of constituent lighting devices. Similarly, the light engine can insert delay between output lighting device commands of different lighting devices. In other cases, the light engine may evaluate the lighting device attributes, characteristic of a lighting effect (e.g., perceived speed of a light effect across constituent lighting devices), current environment conditions (e.g., timing can vary or depend upon number of players or whether a bonus is occurring), etc. Moreover, the light engine may compute start time and end time parameters as well as duration. For example, a light engine may receive a light chain command to display rotating light effects across a light chain in 5 seconds. After determining that the light chain comprises 3 constituent lighting devices, the light engine determines that each lighting device should display shifting light effects for 5/3 seconds. The light engine also determines that a first lighting device should start displaying the shifting light effects at time t=o, and end at t=5/3; the second lighting device should start displaying the shifting light effects at time t=5/3, and end at t=10/3; and the third lighting device should start displaying the shifting light effects at time t=10/3, and end at t=5. The flow continues at block 216.

At block 216, a command sequence to implement the light chain command is constructed. The command sequence is constructed with the lighting device commands and parameter values determined at block 210. The command sequence is also constructed based on the timing values and delay, if any, determined at block 214. A light engine establishes an order for the lighting device commands to occur. The light engine can construct the command sequence in accordance with the order of the lighting devices (i.e., add lighting devices commands as it traverses the constituent lighting devices of the light chain). In some cases, the light engine may modify an initially constructed command sequence based on subsequent passes of the command sequence. For example, the light engine can evaluate the command sequence to determine whether later added lighting device commands affect predecessor lighting commands in the command sequence. The light engine can construct a command sequence or modify a command sequence based on conditionals or rules defined for light chain commands, lighting device commands, lighting devices, user preference data, gaming establishment preference/configuration data, etc.

The light engine can communicate the command sequence in different forms and in accordance with various techniques. The light engine may generate an executable/interpretable file (e.g., a script), and then transmit the file for execution by another device and/or process. The light engine may communicate the sequence of commands to another device (e.g., lighting controller) by a variety of means (e.g., streaming the sequences, issuing each command, etc). In addition, the light engine can implement delay with a DELAY command, or implement the delay by waiting to send a next command.

Light chaining and dynamic controlling of multiple lighting devices that constitute a light chain improves efficiency of producing light effects, including the gradient light effect. Manual programming of individual light bars to produce the gradient light effect across the multiple light bars can be very tedious. This is because displaying the gradient light effect requires knowledge of the number of light bars across which the gradient light effect is to be produced, and also involves calculating a gradient step based on the number of light bars involved and the desired variation of color. In other words, a step function at any particular light bar in the multiple light bars should be known and the each light bar should be independently programmed so that the light source elements in each of the multiple light bars, collectively, produce the gradient light effect. Chaining light bars together to operate as a single unit improves efficiency and ease to dynamically generate the gradient effect without prior knowledge of the number of light bars or number of light source elements in each light bar as will be described with reference to FIG. 3.

Figure 3:
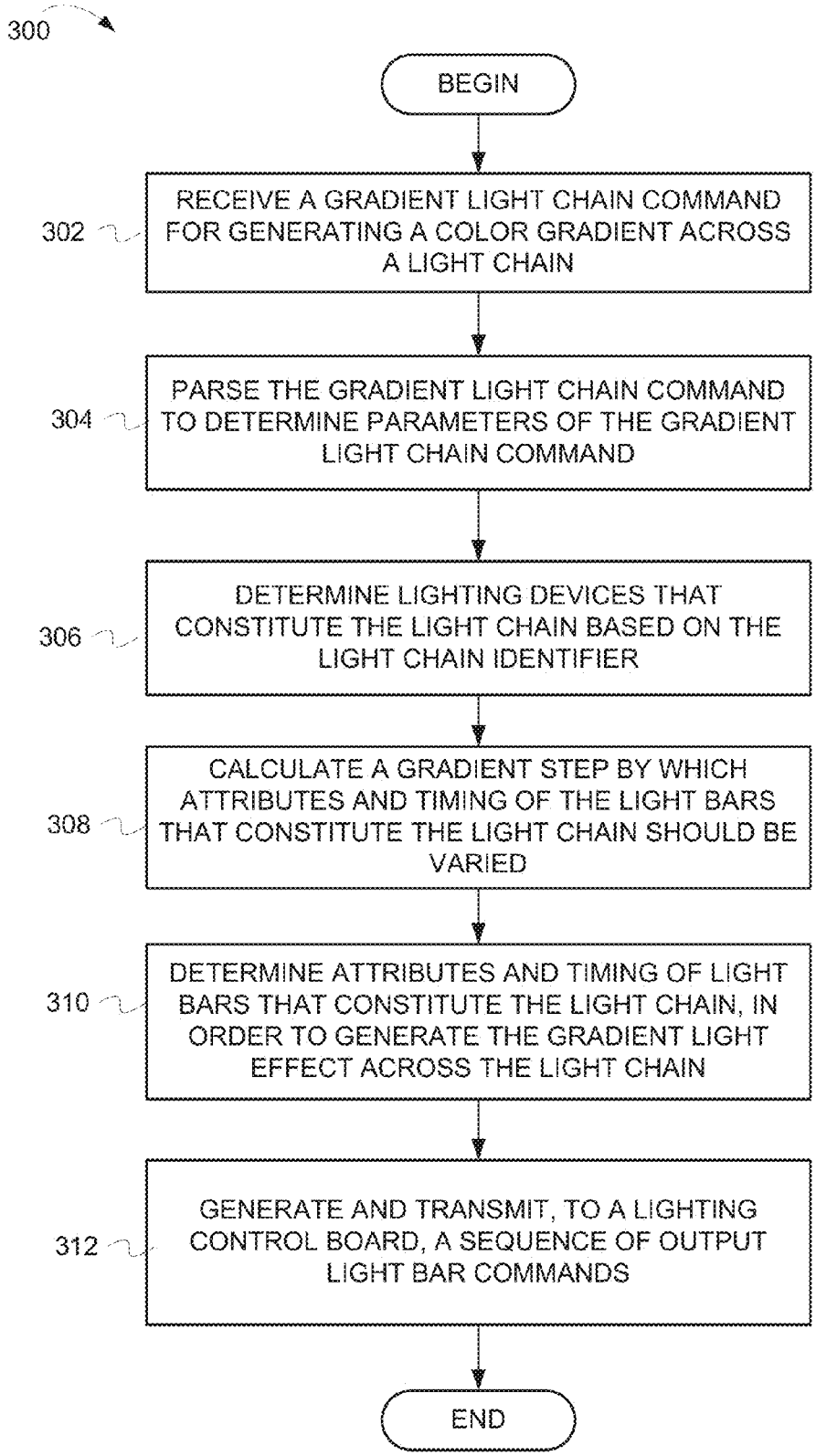
FIG. 3 is a flow diagram illustrating example operations for displaying a gradient light effect across a light chain.

FIG. 3 is a flow diagram illustrating example operations for displaying a gradient light effect across a light chain. Flow 300 begins at block 302.

At block 302, a light chain command for generating a color gradient light effect across a light chain ("gradient light chain command") is received. A server or the wagering gamemachine may execute a light effect script in response to detecting an event and a script interpreter on the server/wagering game machine may identify the gradient light chain command and pass the gradient light chain command to a light engine. The flow continues at block 304.

At block 304, the gradient light chain command is parsed to determine parameters of the gradient light chain command. The gradient light chain command comprises a parameter values that at least indicate a light chain across which the gradient light effect should be displayed, a beginning color of the gradient, an ending color of the gradient, and a light intensity. A light chain identifier may be determined from the parameters of the gradient light chain command. The light chain identifier identifies lighting devices, on one or more wagering game machines, that are logically grouped together to form the light chain. The light chain identifier can also be used to determine an order in which the light bars of the light chain are linked so as to define a flow of light from one lighting device to another lighting device within the light chain.

The beginning and ending colors of the gradient may be indicated, in the gradient light chain command, in terms of RGB values. For example, CHAIN_GRADIENT (CHAIN_1, 255,0,0, 0,0,255) may indicate that the gradient light effect should be displayed across CHAIN_1 such that the beginning color of the gradient is red and the ending color of the gradient is blue. Alternately, the beginning and the ending colors of the gradient may be indicated using pre-defined words. With reference to the above example, the gradient light chain command may be received in the form CHAIN_GRADIENT (CHAIN_1,RED,BLUE). In some implementations, color transitions in the light chain may be indicated in terms of a percentage. For example, the gradient light chain command may indicate that 80% of the light chain should display a hue of red and 20% of the light chain should display a hue of blue. The flow continues at block 306.

At block 306, the light lighting devices that constitute the light chain are determined based on the light chain identifier. For example, a lighting device chain structure or a light chain configuration file can be accessed to determine lighting device identifiers of the lighting device that constitute the light chain. The lighting device identifiers may also be indicative of properties of the lighting device. The lighting device identifiers can be used to determine a position (orientation) of the lighting device on the wagering game machine(s). In some implementations, a number of light source elements in each of the lighting device, a relative position of each of the light source elements, light source element identification numbers, etc., may also be determined. The flow continues at block 308.

At block 308, a gradient step by which attributes of the lighting device that constitute the light chain should be varied is calculated. The gradient step may be used to determine a color gradient for the lighting device within the light chain. The gradient step may also be used to calculate a timing by which gradient effects should be displayed on the lighting device. The gradient step, by which attributes and timing of lighting device in the light chain should be varied, may be determined based on a total number of lighting device that constitute the light chain.

The gradient step may also be determined based on the beginning color of the gradient, the ending color of the gradient, and a percentage (if specified) of the light chain that should comprise a certain hue of color. In one implementation, the gradient step is determined as an inverse of the total number of lighting devices in the light chain. For example, if there are 4 light bars in the light chain, the gradient step may be determined to be ¼. The flow continues at block 310.

At block 310, the attributes and timing of the lighting devices that constitute the light chain are determined in order to generate the gradient light effect across the light chain. Based on knowledge of the beginning color, the ending color, and the gradient step, a proper transition from one color to another color across the light chain can be calculated by dividing the color transition by the total number of lighting devices in the light chain. Based on knowledge of the beginning color, the ending color and the gradient step, a percentage of color variation across the lighting devices that constitute the light chain can also be determined. Accordingly, the light intensity/light color of LED light pixels, for instance, in each of the lighting devices in the light chain can be scaled/varied by the determined percentage. For a light chain that comprises two light bars, it may be determined that the first light bar should display the range of colors that start with a color of 100% red and 0% blue and end with a color of 50% red and 50% blue. Additionally, it may be determined that the second light bar should display the range of colors that start with a color of 50% red and 50% blue and end with color of 0% red and 100% blue. A time interval for which the gradient light effect should be maintained across the light chain may also be determined. Additionally, a time instant at which the light bars should start displaying the gradient light effect may be determined. For example, it may be determined that the gradient light effect across all the light bars in the light chain should be displayed simultaneously. As another example, it may be determined that gradient light effects should be staggered. It may be determined that the first light bar should begin displaying the gradient light effect at t=0, the second light bar should begin displaying the gradient light effect at t=1 sec, and so on. The flow continues at block 312.

At block 312, a sequence of output lighting device commands to display the gradient light effect, are transmitted and generated to a lighting control board. Each of the output lighting device commands can indicate the parameter values and timing of light source elements that constitute a lighting device. For example, BAR_GRADIENT (BAR_1, 255, 0, 0, 127, 0, 128) may indicate that the gradient light effect across the light bar BAR_1 should range from 100% red to 50% red and 50% blue. BAR_GRADIENT (BAR_2, 127, 0, 128, 0, 0, 255) may indicate that the gradient light effect across the light bar BAR_2 should range from 50% red and 50% blue to 100% blue. The lighting control board, in turn, can receive the output lighting device commands and analyze the output lighting device commands. The lighting control board can translate the output lighting device commands into control data (e.g., DMX data) that indicates how lighting control structures (e.g., dimmers) should vary the attributes of light source elements that constitute lighting devices.

In another implementation, the attributes and timing for each lighting device in the light chain may be stored in specified memory locations. For example, each light bar may be associated with a data structure that holds indications of light hue, light intensity, etc. In transmitting the sequence of output lighting device commands to the lighting control board, light bar identifiers and corresponding memory addresses from where the attributes of the lighting devices can be retrieved may be transmitted. The lighting control unit can, in turn, retrieve the set of output lighting device commands from memory and generate control data to vary attributes of the light source elements to produce the desired gradient light effect. From block 312, the flow ends.

It should be noted that because the lighting devices across which the gradient effect is to be displayed are chained together, the gradient step can be dynamically calculated based on determining, at runtime, the total number of lighting devices that constitute the light chain. This precludes the need for individually programming each lighting device in a set of multiple lighting devices to generate the gradient light effect. At runtime, a light engine (e.g., the light engine 112 of FIG. 1) can determine the number of lighting devices that constitute the light chain, calculate the gradient step, and generate the set of output lighting device commands based on knowledge of the gradient step and gradient colors. The number of lighting devices in the light chain may change, e.g., from four light bars to six light bars. At runtime, light engine 112 can determine a new number of lighting devices that constitute the light chain, identify the lighting devices that constitute the light chain, accordingly calculate a new gradient step, and issue output lighting device commands for producing the gradient light effect.

It should also be noted that although FIGS. 1-3 describe light chains as constituting lighting devices on a single wagering game machine, in some implementations, the light chain can constitute lighting devices across any suitable number of wagering game machines and associate non-wagering game machines (e.g., overhead lighting devices associated with a bank of wagering game machines). Light chain commands may be executed (as described with reference to FIGS. 1-3) to produce light effects across multiple wagering game machines. For example, a light chain can constitute two light bars where a first light bar is located on a first wagering gamemachine and a second light bar is located on a second wagering gamemachine. On receiving the gradient light chain command, the light engine 112 can perform operations to display a gradient light effect across the two wagering game machines. Moreover, once the light engine 112 determines the set of output lighting device commands, the light engine could identify output lighting device commands associated with each of the two wagering game machines and accordingly transmit the appropriate output lighting device commands to the wagering game machines. The light engine may determine a first set of output lighting device commands for the first light bar on the first wagering game machine and a second set of output lighting device commands for the second light bar on the second wagering game machine. The light engine can transmit the first set of output lighting device commands to a lighting control board associated with the first wagering game machine and can transmit the second set of output lighting device commands to a lighting control board associated with the second wagering gamemachine, so as to generate the light effect indicated by the light chain command. In some implementations, however, a common lighting control unit may control the light bars of multiple wagering game machines in a casino. The light engine may, therefore, transmit the output lighting device commands to the common lighting control unit and direct the lighting control unit to vary lighting of the light bars in accordance with the output lighting device commands so as to generate the light effects.

In addition to controlling lighting of lighting devices affixed to one or more wagering game machines, the light engine 112 may also control light source elements that provide lighting on a casino floor. For example, the light engine 112 may control a color, intensity, and position of striplights. The striplights may comprise light bulbs covered with colored glass or gels. The light engine may control an intensity of light emitted by various light bulbs that constitute the striplight to produce light effects across the casino. Alternately, the striplight can even comprise LEDs. As another example, the light engine 112 may control timing and attributes (e.g., intensity, color, direction of light) of spotlights to produce light shows across the casino.

Operating Environment

This section describes an example operating environment and presents structural aspects of some embodiments. This section includes discussion about wagering game networks and wagering game machine architectures.

Wagering Game Networks

Figure 4:
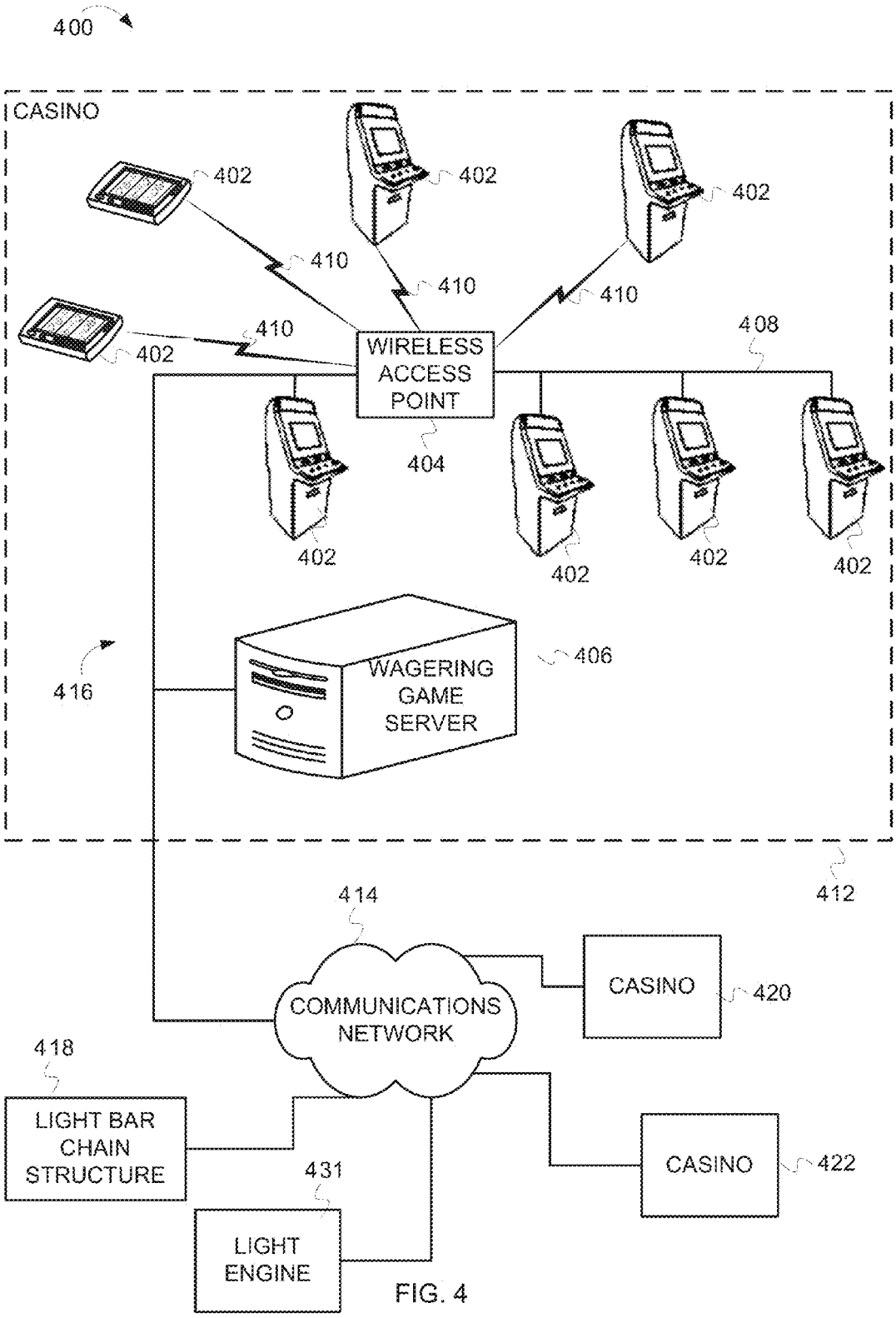
FIG. 4 is a block diagram illustrating a wagering game network, according to example embodiments of the invention.

FIG. 4 is a block diagram illustrating a wagering game network 400, according to example embodiments of the invention. As shown in FIG. 4, the wagering game network 400 includes a plurality of casinos 412, 420, and 422 connected to a communications network 414. The plurality of casinos 412, 420, and 422 is also connected to a light engine 431 and a lighting device chain structure 418 via the communications network 414.

Each casino 412 includes a local area network 416, which includes an access point 404, a wagering game server 406, and wagering game machines 402. The access point 404 provides wireless communication links 410 and wired communication links 408. The wired and wireless communication links can employ any suitable connection technology, such as Bluetooth, 802.11, Ethernet, public switched telephone networks, SONET, etc. In some embodiments, the wagering game server 406 can serve wagering games and distribute content to devices located in other casinos 412 or at other locations on the communications network 414.

The light engine 431 implements functionality for dynamically determining a set of lighting device commands to implement a light chain command across multiple lighting devices that constitute a light chain. In one implementation, the wagering game server 406 detects a game based event, executes a light effect script in response to detecting the game-based event, identifies a light chain command, and transmits the light chain command to the light engine 431. It should be noted, however, that in some implementations, the wagering game machine 402 or any suitable server in the network 400 may identify and transmit the light chain command to the light engine 412. In some embodiments, the light engine 431 selects a light chain command responsive to the wagering game server 406 detecting a trigger for a light effect. The light chain command references a light chain, which represents a combination of one or more light bars across which light effects should be displayed. On receiving the light chain command, the light engine 412 queries, using the light chain identifier, the lighting device chain structure 418 and determines the light bars that constitute the light chain. The light engine 431 also determines attributes of the light bars based on knowledge of the light bars that constitute the light chain, so as to generate light effects in accordance with the light chain command. The light engine 431 generates a set of output lighting device commands and transmits the set of output lighting device commands to a lighting control board. The lighting control board can, based on the output lighting device commands, generate control commands to vary the attributes and timing of each light source element that constitutes the light bars.

The wagering game machines 402 described herein can take any suitable form, such as floor standing models, bartop models, workstation-type console models, etc., which can be associated with lighting devices. Further, the wagering game machines 402 can be primarily dedicated for use in conducting wagering games, or can include non-dedicated devices, such as mobile phones, personal digital assistants, personal computers, etc. In one embodiment, the wagering game network 400 can include other network devices, such as accounting servers, wide area progressive servers, player tracking servers, and/or other devices suitable for use in connection with embodiments of the invention.

In some embodiments, wagering game machines 402 and wagering game servers 406 work together such that a wagering game machine 402 can be operated as a thin, thick, or intermediate client. For example, one or more elements of game play may be controlled by the wagering game machine 402 (client) or the wagering game server 406 (server). Game play elements can include executable game code, lookup tables, configuration files, game outcome, audio or visual representations of the game, game assets or the like. In a thin-client example, the wagering game server 406 can perform functions such as determining game outcome or managing assets, while the wagering game machine 402 can present a graphical representation of such outcome or asset modification to the user (e.g., player). In a thick-client example, the wagering game machines 402 can determine game outcomes and communicate the outcomes to the wagering game server 406 for recording or managing a player's account.

In some embodiments, either the wagering game machines 402 (client) or the wagering game server 406 can provide functionality that is not directly related to game play. For example, account transactions and account rules may be managed centrally (e.g., by the wagering game server 406) or locally (e.g., by the wagering gamemachine 402). Other functionality not directly related to game play may include power management, presentation of advertising, software or firmware updates, system quality or security checks, etc.

Any of the wagering game network components (e.g., the wagering game machines 402) can include hardware and machine-readable media including instructions for performing the operations described herein. The following section describes architecture of the wagering game machine.

Wagering Game Machine Architectures

Figure 5:
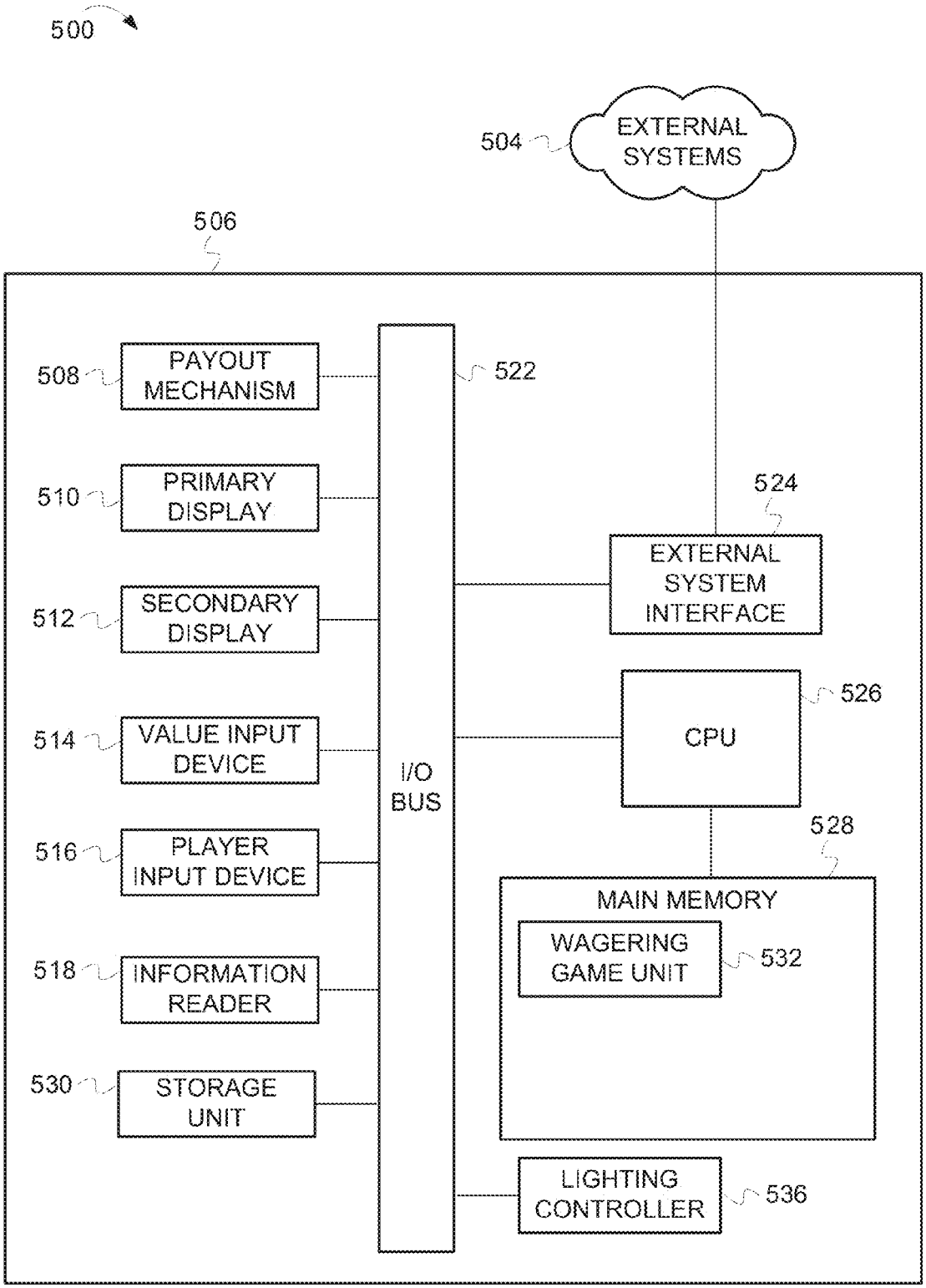
FIG. 5 is a block diagram illustrating wagering game machine architecture, according to example embodiments of the invention.

FIG. 5 is a block diagram illustrating wagering game machine architecture, according to example embodiments of the invention. As shown in FIG. 5, the wagering game machine architecture 500 includes a wagering game machine 506, which includes a central processing unit (CPU) 526 connected to main memory 528. The CPU 526 can include any suitable processor, such as an Intel® Pentium processor, Intel® Core 2 Duo processor, AMD Opteron™ processor, or UltraSPARC processor. The main memory 528 comprises a wagering game unit 532. In one embodiment, the wagering game unit 532 can present wagering games, such as video poker, video blackjack, video slots, video lottery, etc., in whole or part.

The wagering game machine 506 also comprises a lighting controller 536. The lighting controller 536 can be an application specific integrated circuit, a lighting control board, field programmable gate array, co-processor, etc. The lighting controller 536 implements functionality to control lighting on the wagering gamemachine 502 in accordance with instructions from a light engine (e.g., as described with reference to FIGS. 1-4). The lighting controller 536 receives output lighting device commands from a light engine, and generates and transmits digital or analog control data to a set of lighting control structures (e.g., dimmers, faders, rotary encoders, etc.). The control data can indicate a current (or voltage) that should be applied to, an intensity of, and an angle of rotation of structures that house the light source elements of each lighting device that constitutes a light chain. In some implementations, the lighting controller 536 may transmit DMX data to the lighting control structures and the lighting control structures can, in turn, control the light source elements. On receiving the output lighting device commands, the lighting controller 536 can vary the inputs to light source element LEDs, for example, in each of the lighting devices so as to generate light effects in accordance with the light chain commands.

A light engine can be embodied on a server as described with reference to FIG. 4, which communicates with the lighting controller 536. But in some embodiments, functionality of a light engine can be implemented at both a server and a wagering game machine, or in the wagering game machine alone. The memory unit 528 can comprise a light engine (not shown) that performs the functionality for receiving light chain commands, determining lighting devices that constitute the light chain, and determining output lighting device commands with any determined parameter values and/or timing values.

Moreover, embodiments can implement an architecture that allows for a wagering gamemachine to control light chains on other wagering game machines, or even a light chain that spans multiple wagering game machines and non-wagering game machines. A light engine can be installed on a wagering game machine that issues lighting device commands to machines associated with light chains. In some embodiments, multiple wagering game machines can comprise light engines. One of the wagering game machines can be designated as a currently active light engine, while the other light engines operate as failover light engines.

The CPU 526 is also connected to an input/output (I/O) bus 522, which can include any suitable bus technologies, such as an AGTL+ frontside bus and a PCI backside bus. The I/O bus 522 is connected to the lighting controller 536, a payout mechanism 508, primary display 510, secondary display 512, value input device 514, player input device 516, information reader 518, and storage unit 530. The player input device 516 can include the value input device 514 to the extent the player input device 516 is used to place wagers. The I/O bus 522 is also connected to an external system interface 524, which is connected to external systems 504 (e.g., wagering game networks).

In one embodiment, the wagering game machine 506 can include additional peripheral devices and/or more than one of each component shown in FIG. 5. For example, in one embodiment, the wagering game machine 506 can include multiple external system interfaces 524 and/or multiple CPUs 526. In one embodiment, any of the components can be integrated or subdivided.

Any component of the architecture 500 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). Examples of a machine-readable storage medium include read only memory (ROM), random access memory (RAM), magnetic disk storage media, optical storage media, flash memory machines, etc. Examples of a machine-readable signal transmission medium include copper wires, fiber optics, wireless transmission media, etc.

Example Wagering Game Machines

Figure 6:
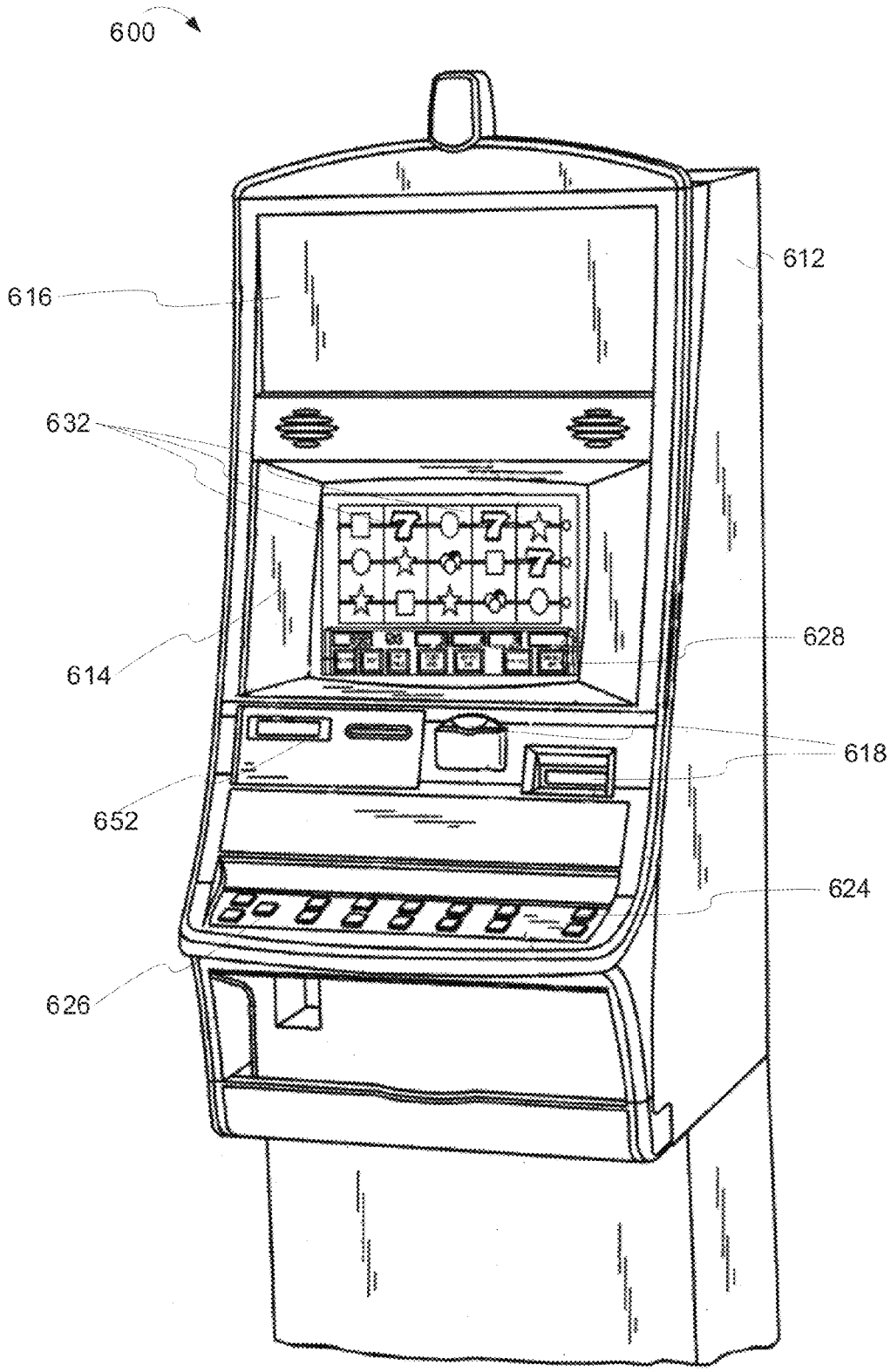
FIG. 6 is a perspective view of a wagering game machine, according to example embodiments of the invention.

FIG. 6 is a perspective view of a wagering game machine, according to example embodiments of the invention. Referring to FIG. 6, a wagering game machine 600 is used in gaming establishments, such as casinos. According to embodiments, the wagering game machine 600 can be any type of wagering game machine and can have varying structures and methods of operation. For example, the wagering gamemachine 600 can be an electromechanical wagering game machine configured to play mechanical slots, or it can be an electronic wagering gamemachine configured to play video casino games, such as blackjack, slots, keno, poker, blackjack, roulette, etc.

The wagering game machine 600 comprises a housing 612 and includes input devices, including value input devices 618 and a player input device 624. For output, the wagering game machine 600 includes a primary display 614 for displaying information about a basic wagering game. The primary display 614 can also display information about a bonus wagering game and a progressive wagering game. The wagering game machine 600 also includes a secondary display 616 for displaying wagering game events, wagering game outcomes, and/or signage information. While some components of the wagering game machine 600 are described herein, numerous other elements can exist and can be used in any number or combination to create varying forms of the wagering game machine 600.

The value input devices 618 can take any suitable form and can be located on the front of the housing 612. The value input devices 618 can receive currency and/or credits inserted by a player. The value input devices 618 can include coin acceptors for receiving coin currency and bill acceptors for receiving paper currency. Furthermore, the value input devices 618 can include ticket readers or barcode scanners for reading information stored on vouchers, cards, or other tangible portable storage devices. The vouchers or cards can authorize access to central accounts, which can transfer money to the wagering gamemachine 600.

The player input device 624 comprises a plurality of push buttons on a button panel 626 for operating the wagering game machine 600. In addition, or alternatively, the player input device 624 can comprise a touch screen 628 mounted over the primary display 614 and/or secondary display 616.

The various components of the wagering gamemachine 600 can be connected directly to, or contained within, the housing 612. Alternatively, some of the wagering gamemachine's components can be located outside of the housing 612, while being communicatively coupled with the wagering game machine 600 using any suitable wired or wireless communication technology.

The operation of the basic wagering game can be displayed to the player on the primary display 614. The primary display 614 can also display a bonus game associated with the basic wagering game. The primary display 614 can include a cathode ray tube (CRT), a high resolution liquid crystal display (LCD), a plasma display, light emitting diodes (LEDs), or any other type of display suitable for use in the wagering gamemachine 600. Alternatively, the primary display 614 can include a number of mechanical reels to display the outcome. In FIG. 6, the wagering gamemachine 600 is an "upright" version in which the primary display 614 is oriented vertically relative to the player. Alternatively, the wagering game machine can be a "slant-top" version in which the primary display 614 is slanted at about a thirty-degree angle toward the player of the wagering game machine 600. In yet another embodiment, the wagering game machine 60000 can exhibit any suitable form factor, such as a free standing model, bartop model, mobile handheld model, or workstation console model.

A player begins playing a basic wagering game by making a wager via the value input device 618. The player can initiate play by using the player input device's buttons or touch screen 628. The basic game can include arranging a plurality of symbols along a payline 632, which indicates one or more outcomes of the basic game. Such outcomes can be randomly selected in response to player input. At least one of the outcomes, which can include any variation or combination of symbols, can trigger a bonus game.

In some embodiments, the wagering game machine 600 can also include an information reader 652, which can include a card reader, ticket reader, bar code scanner, RFID transceiver, or computer readable storage medium interface. In some embodiments, the information reader 652 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method of controlling a light chain in a wagering game environment, the method comprising:

determining the light chain indicated in a light chain command for creating a light effect with the light chain;

accessing light chain structure data that indicate a plurality of light chains and a plurality of constituent lighting devices for each of the plurality of light chains, wherein the plurality of light chains includes the light chain;

determining, from the light chain structure data, the plurality of constituent lighting devices that constitute the light chain and configuration of the light chain with respect to the plurality of constituent lighting devices that constitute the light chain;

determining attributes for each of the plurality of constituent lighting devices that constitute the light chain;

for each of the plurality of constituent lighting devices that constitute the light chain, determining at least one lighting device command based on the light chain command and on the configuration of the light chain;

constructing a command sequence with the lighting device commands to implement the light chain command for creating the light effect based, at least in part, on the attributes; and transmitting each of the lighting device commands to corresponding ones of the plurality of constituent lighting devices in accordance with the command sequence.

2. The method of claim 1 further comprising:

for each of the lighting device commands, determining one or more parameters; and assigning values to the parameters based, at least in part, on the attributes of the plurality of constituent lighting devices.

3. The method of claim 2, wherein said assigning the values to the parameters, based, at least in part, on the attributes of the plurality of constituent lighting devices comprises:

computing an increment with which a first of the attributes of a first of the plurality of constituent lighting devices should be varied based, at least in part, on the configuration of the light chain, wherein the values comprise the increment.

4. The method of claim 1, wherein said determining the configuration of the light chain from the light chain structure data comprises determining at least one of positions of each of the plurality of constituent lighting devices with respect to a wagering game machine, a number of the plurality of constituent lighting devices, arrangement of the plurality of constituent lighting devices with respect to the wagering game machine, and location of the light chain with respect to a second light chain associated with a second wagering game machine.

5. The method of claim 1 further comprising:

computing a timing value for a first of the lighting device commands to be performed by a first of the plurality of constituent lighting devices, wherein said constructing the command sequence accounts for the timing value.

6. The method of claim 5, wherein said constructing the command sequence that accounts for the timing value comprises at least one of inserting a delay that accounts for the timing value and setting a first parameter of the parameters to the timing value, wherein the first parameter is of the first lighting device command.

7. The method of claim 5, wherein said computing the timing value for the first of the lighting device commands comprises one of computing a time instant at which the first of the plurality of constituent lighting devices should begin performing the first lighting device command, computing a time instant at which the first of the plurality of constituent lighting devices should stop performing the first lighting device command, and computing a time interval for which to perform the first lighting device command.

8. The method of claim 5, wherein said computing the timing value comprises:

determining a duration of the light effect;

computing a portion of the duration of the light affect allocated for each of the plurality of constituent lighting devices to perform those of the plurality of lighting device commands corresponding thereto.

9. The method of claim 1, wherein a first of the plurality of lighting devices comprises one of a light bar, a light emitting diodes lighting device, a light bulb, a fluorescent lighting device, a high intensity discharge lamp, a gas discharge lamp, and a strip light.

10. The method of claim 1, wherein said determining the attributes for each of the plurality of constituent lighting devices comprises determining at least one of a light intensity, a range of intensity variation across the constituent lighting device, a light color, a tilt of the constituent lighting device, a rotation of the constituent lighting device, a movement of the constituent lighting device, and a range of color variations across the constituent lighting device.

11. The method of claim 1 further comprising:

receiving a light effect script via a wagering game network; and determining that the light effect script comprises the light chain command.

12. The method of claim 1, wherein said determining the attributes for each of the plurality of constituent lighting devices that constitute the light chain comprises querying a first of the plurality of constituent lighting devices to determine a first of the attributes that corresponds to the first constituent lighting device.

13. A machine-readable storage medium having instructions stored therein for controlling a light chain of a wagering game machine, the instructions, when executed, cause a machine to:

parse a light chain command and determine the light chain indicated by the light chain command, wherein the light chain command corresponds to a light effect;

determine a plurality of lighting devices that constitute the light chain and a configuration of the plurality of lighting devices;

determine attributes of the plurality of lighting devices that constitute the light chain;

for each of the plurality of lighting devices that constitute the light chain, determine at least one lighting device command based on the light chain command and the configuration of the light chain; and construct a command sequence with the lighting device commands to create the light effect based, at least in part, on the attributes.

14. The machine-readable storage medium of claim 13, wherein the instructions also cause the machine to compute a timing value for a first of the lighting device commands to be performed by a first of the plurality of lighting devices of a wagering game machine, wherein the instructions to cause the machine to construct the command sequence also cause the machine to account for the timing value in the command sequence.

15. The machine-readable storage medium of claim 13, wherein the instructions also cause the machine to determine one or more parameters for each of the lighting device commands, and to assign values to the parameters based, at least in part, on the attributes of the plurality of lighting devices.

16. A machine-readable storage medium having instructions stored therein for controlling a light chain of a wagering game machine, the instructions, when executed, cause a machine to:

determine a light chain indicated in a light chain command for creating a light effect with the light chain in a wagering game environment;

access light chain structure data that indicate a plurality of light chains and a plurality of constituent lighting devices for each of the plurality of light chains, wherein the plurality of light chains includes the light chain;

determine, from the light chain structure data, the plurality of constituent lighting devices that constitute the light chain and configuration of the light chain with respect to the plurality of constituent lighting devices that constitute the light chain;

determine attributes for each of the plurality of constituent lighting devices that constitute the light chain;

for each of the plurality of constituent lighting devices that constitute the light chain, determine at least one lighting device command based on the light chain command and the configuration of the light chain; and construct a command sequence with the lighting device commands to implement the light chain command for creating the light effect based, at least in part, on the attributes.

17. The machine-readable storage medium of claim 16, wherein the instructions also cause the machine to transmit each of the lighting device commands to corresponding ones of the plurality of constituent lighting devices in accordance with the command sequence.

18. The machine-readable storage medium of claim 16, wherein the instructions also cause the machine to determine one or more parameters for each of the lighting device commands, and to assign values to the parameters based, at least in part, on the attributes of the plurality of constituent lighting devices.

19. The machine-readable storage medium of claim 18, wherein to cause the machine to assign the values to the parameters, based, at least in part, on the attributes of the plurality of constituent lighting devices comprises the instructions to cause the machine to:

compute an increment by which a first of the attributes of a first of the plurality of constituent lighting devices should be varied based, at least in part, on the configuration of the light chain, wherein the values comprise the increment.

20. The machine-readable storage medium of claim 16, wherein the instructions also cause the machine to compute a timing value for a first of the lighting device commands to be performed by a first of the plurality of lighting devices of the wagering game machine, wherein the command sequence accounts for the timing value.

21. An apparatus comprising:

a processor;

a network interface operable to receive a light chain command; and a light engine operable to, determine a light chain indicated by the light chain command, wherein the light chain is associated with a wagering game machine;

access light chain structure data that indicate a plurality of light chains and a plurality of constituent lighting devices for each of the plurality of light chains, wherein the plurality of light chains includes the light chain;

determine, from the light chain structure data, the plurality of constituent lighting devices that constitute the light chain and configuration of the light chain with respect to the plurality of constituent lighting devices that constitute the light chain;

determine attributes for each of the plurality of constituent lighting devices that constitute the light chain;

for each of the plurality of constituent lighting devices that constitute the light chain, determine at least one lighting device command based on the light chain command and the configuration of the light chain; and construct a command sequence with the lighting device commands to implement the light chain command for creating the light effect based, at least in part, on the attributes.

22. The apparatus of claim 21 further comprising a machine-readable storage medium that embodies the light engine.

23. An apparatus comprising:

a network interface operable to receive a light chain command; and means for determining a configuration of lighting devices that constitute a light chain from a light chain command for creating a light effect, wherein the light chain is associated with a wagering game machine; and means for constructing a sequence of operations to implement the light chain command; and means for causing each of the lighting devices that constitute the light chain to perform corresponding ones of the sequence of operations in accordance with the sequence.

24. The apparatus of claim 23 further comprising means for determining attributes of the lighting devices that constitute the light chain that is associated with the wagering game machine, wherein the means for constructing the sequence of operations to implement the light chain command construct the sequence of operations based, at least in part, on the attributes and the configuration of lighting devices.

25. The apparatus of claim 23 further comprising means for computing a timing value, wherein the sequence of operations account for the timing value.

* * * * *